US005196241A

United States Patent [19]

Burke et al.

[11] Patent Number: 5,196,241

[45] Date of Patent: Mar. 23, 1993

[54] METHOD FOR PROCESSING SUBSTRATES PRINTED WITH PHASE-CHANGE INKS

[75] Inventors: Edward F. Burke, Lake Oswego; Donald R. Titterington, Tualatin; James D. Rise, Beaverton; Joern B. Eriksen, Oregon City; Clark W. Crawford, Wilsonville, all of Oreg.

[73] Assignee: Tektronix, Inc., Wilsonville, Oreg.

[21] Appl. No.: 681,252

[22] Filed: Apr. 8, 1991

[51] Int. Cl.[5] ..... B05D 3/12

[52] U.S. Cl. ..... 427/444; 427/162; 427/164; 427/277; 427/368; 427/369; 427/370; 118/101; 118/121; 346/1.1

[58] Field of Search ..... 427/164, 271, 277, 278, 427/355, 359, 365, 366, 368, 369, 370, 444, 162; 118/101, 112, 114, 119, 121, 122; 346/1.1, 25, 135.1, 140 R

[56] References Cited

U.S. PATENT DOCUMENTS

| | | | |
|---|---|---|---|
| 2,788,296 | 4/1957 | Louis | 427/370 |
| 3,415,671 | 12/1968 | Rice | 427/368 |
| 4,743,920 | 5/1988 | Tohma et al. | 346/1.1 |
| 4,745,420 | 5/1988 | Gerstenmaier | 346/140 R |
| 4,751,528 | 6/1988 | Spehrley, Jr. et al. | 346/140 R |
| 4,801,473 | 1/1989 | Creagh et al. | 427/164 |
| 4,853,706 | 8/1989 | Van Brimer et al. | 346/25 |
| 4,889,761 | 12/1989 | Titterington et al. | 428/195 |
| 4,992,304 | 2/1991 | Titterington | 427/164 |
| 5,064,692 | 11/1991 | Hofmann et al. | 427/366 |
| 5,113,200 | 5/1992 | Deguchi et al. | 346/25 |

FOREIGN PATENT DOCUMENTS

| | | | |
|---|---|---|---|
| 0308117 | 3/1989 | European Pat. Off. . | |
| 56-126126 | 10/1981 | Japan | 427/355 |

*Primary Examiner*—Shrive Beck
*Assistant Examiner*—Terry J. Owens
*Attorney, Agent, or Firm*—John D. Winkelman; Ann W. Speckman

[57] ABSTRACT

Methods and apparatus for processing printed substrates having a phase change ink layer of non-uniform thickness are disclosed. Application of a combination of heat and pressure reorients the printed ink layer to provide a layer having a substantially uniform thickness and flat surface conformation, at least in the area of each discrete color. A release surface (55) is positioned adjacent the printed ink layer during processing. A resilient contact surface (56) is also provided to facilitate reorientation of the printed ink layer. Mechanical buffing of the processed, printed substrate improves image quality. Application of a light transmissive, protective coating that overlays the printed ink layer also improves image quality.

17 Claims, 3 Drawing Sheets

METHOD FOR PROCESSING SUBSTRATES PRINTED WITH PHASE-CHANGE INKS

TECHNICAL FIELD

The present invention relates generally to methods of processing substrates printed with phase change ink, and relates more specifically to methods of processing substrates such as light transmissive media printed with phase change ink to provide improved color images by overhead projection.

BACKGROUND OF THE INVENTION

In general, phase change inks are solid at ambient temperatures and liquid at the elevated operating temperatures of an ink jet printing device. Liquid phase ink jet droplets are ejected from the printing device at an elevated operating temperature and, when the ink droplets contact the surface of a substrate, they quickly solidify to form a predetermined pattern.

Phase change ink is advantageous for printing purposes since it remains in a solid phase at room temperature during shipping, long-term storage, etc. Also, problems associated with nozzle clogging due to ink evaporation are largely eliminated, thereby improving the reliability of ink jet printing. Furthermore, since the ink droplets solidify rapidly upon contact with the substrate, migration of ink along the printing medium is greatly reduced and image quality is improved. Rapid solidification allows high quality images to be printed on a wide variety of printing media.

Early references to phase change inks for ink jet printing involved monochrome inks jetted by electrostatic printing devices. Thus, for example, U.S. Pat. No. 3,653,932 discloses a low melting point (30° C. to 50° C.) ink having a base comprising di-esters of sebacic acid. In a similar process, U.S. Pat. No. 3,715,219 describes low melting point (30° C. to 60° C.) inks including a paraffin alcohol-based ink. One disadvantage of printing with low melting point phase change inks is that they frequently exhibit offset problems. Specifically, when substrates printed with these inks are stacked and stored for subsequent use, the ink adheres to adjacent surfaces, particularly if the printed substrates are exposed to high ambient temperatures.

Phase change inks are well known in the art. U.S. Pat. Nos. 4,390,369 and 4,484,948 describe methods for producing monochrome phase change inks that employ a natural wax ink base, such as Japan wax, candelilla wax, and carnauba wax, which are subsequently printed from a drop-on-demand ink jet device at a temperature ranging between 65° C. and 75° C. U.S. Pat. No. 4,659,383 discloses a monochrome ink composition having an ink base including a C20-24 acid or alcohol, a ketone, and an acrylic resin plasticizer. These monochrome ink compositions are not durable and, when printed, may become smudged upon routine handling and folding.

Japanese Patent Application No. 1,280,578 discloses the use of aliphatic and aromatic amides that are solid at room temperature, such as acetamide, as printing inks. U.S. Pat. No. 4,684,956 is directed to monochrome phase change inks utilizing synthetic microcrystalline wax (hydrocarbon wax) and microcrystalline polyethylene wax. This molten composition can be applied to a variety of porous and non-porous substrates using drop-on-demand ink jet application techniques.

European Patent Application Nos. 0287352 and 0206286 disclose phase change ink jet printing in color.

The ink bases for these systems include fatty acids, a thermoplastic polyethylene and a phase change material in the first application; and the alcohol portion of a thermosetting resin pair, a mixture of organic solvents (o- and p-toluene sulfonamide) and a dye in the second application.

Several prior art references disclose manipulation of printed images formed from phase change inks, either during or following the printing process. In U.S. Pat. No. 4,745,420, droplets of a phase change ink are ejected onto a target and subsequently spread by the application of pressure to increase the coverage and minimize the volume of ink required. In other words, droplets of phase change ink that do not initially cover the entire target are spread over the entire target surface by application of pressure.

Similarly, in xerographic image fusing, the area of contact between the toner and the substrate is substantially increased by causing the toner to spread and penetrate somewhat into the underlying substrate. See Williams, "The Physics and Technology of Xerographic Processes," J. Wiley & Sons (1984). The mechanical properties of the toner are such that plastic deformation and flow occur rapidly. In both of the aforementioned references, the ink or toner spreads across the paper, forming opaque characters or patterns thereon.

Although the previous references describe fusing of images between a pair of mechanically loaded rollers at ambient temperatures, hot roll fusing has also been used in toner applications. In hot roll fusing, two rolls (one heated) are mechanically loaded together and rotated to provide transient application of heat and pressure to the substrate. The toner is typically heated to above its glass transition temperature ($T_g$), which enables it to coalesce, flow, and penetrate the substrate. Rolling pressure and capillary action facilitate coverage. See Dr. John W. Trainer, "Trends and Advances in Dry Toner Fusing," Institute for Graphic Communication (June 1985).

Another system for applying phase change inks, described in U.S. Pat. No. 4,751,528, relates to an ink jet apparatus for the controlled solidification of phase change inks to assist in controlled penetration of the substrate. This apparatus includes a substrate-supporting, thermally conductive platen as well as a heater and a thermoelectric cooling arrangement, both disposed in heat communication with the platen.

Ink jet printing of colored inks onto light-transmissive media for displaying color images by overhead projection has historically been a problem. When aqueous inks are employed, for example, special coatings must be provided on the light-transmissive medium to absorb the solvent so that images of high quality are formed. See U.S. Pat. Nos. 4,503,111, 4,547,405 and 4,555,437. Even though special coatings are not required on receptor films used for phase change ink jet printing, images produced by prior art color phase change inks printed on light transmissive substrate materials are not generally acceptable for use in an overhead projection system.

The development of phase change inks that are substantially transparent, i.e., inks that transmit substantially all of the light that impinges on them, has improved the quality of images printed on light transmissive substrates. Phase change ink compositions disclosed in U.S. Pat. 4,889,761 are exemplary. Projection of images printed on light transmissive substrates using substantially transparent inks is, however, generally unsatisfactory as a consequence of color ink jet printing techniques.

FIG. 1 illustrates schematically the transmission of light through the central portion of an image printed on a light transmissive substrate. As shown in FIG. 1(*a*), ink deposited on a light transmissive substrate 14 solidifies as generally hemispherical droplets 12 that refract impinging light beams 10. Refracted light beams 16 are directed away from the collection lens of a projection system (not shown). Light beams 10 impinging on the printed substrate are therefore transmitted through ink droplets 12 in a non-rectilinear path, even if ink droplets 12 are optically transparent. Consequently, the projected image is visible only in contrast, and the colors of the projected image have a dull grayish cast. This problem is exacerbated by subtractive printing techniques wherein multiple layers of droplets are required to produce secondary colors, while primary colors require a single ink droplet.

Another problem that arises in ink jet printing and is evident in projection of phase change ink printed substrates is "banding." As the printer head and substrate move relative to one another and the printer head deposits successive lines of ink, discrepancies arise in the alignment of adjacent printed lines relative to one another. These alignment discrepancies result in the formation of "bands" in the printed pattern at the interfaces of adjacent printed lines. The bands further detract from the appearance and clarity of a projected image.

U.S. Pat. No. 4,889,761 discloses substrates having a light-transmissive phase change ink printed thereon that are processed to improve the quality of images projected by overhead projection techniques. Printed substrates are processed to reorient the surface configuration of solidified phase change ink droplets to provide a printed ink layer having a generally uniform thickness that is capable of transmitting light in a substantially rectilinear path. As shown in FIG. 1(*b*), light beams 10 impinge on ink layer 20 in a generally rectilinear path, producing collimated transmitted light beams 22 that can be collected by a collection lens of a projection system. Reorientation is achieved by the application of pressure or a combination of heat and pressure to the printed substrate by means of a dual roller assembly Rollers having various constructions are disclosed, including a TEFLON ® coated heated roller and silicone rubber covered pressure roller.

PCT Patent Application No. W0 88/08788 is directed to a method of producing transparencies having curved, light scattering ink droplets printed thereon capable of projecting images. Printed ink droplets are overlaid with a transparent layer having an index of refraction that is substantially the same as the index of refraction of the ink droplets. Preferred coating materials include transparent polyurethane and acrylic. In this manner, the refractive effect of the curvature of the ink deposits is lessened. This publication teaches that the upper surface of the ink covering layer need not be parallel to the substrate surface to achieve this improvement.

European Patent Publication No. 0308117 discloses a transparency having curved, light scattering, colored ink droplets thereon. Exposure of the printed substrate to an elevated temperature of about 70° C.–140° C. achieves spreading and flattening of the ink droplets, but requires a time interval of about 30 seconds to 5 minutes.

Prior art techniques for processing and/or reorienting phase change ink droplets printed on a substrate generally have not provided satisfactory results. Offset problems and problems resulting from the non-uniform distribution of ink droplets persist, especially where multiple ink droplet layers are required. Moreover, most existing processing cycles require unacceptable time periods for completion and thus are not commercially viable alternatives.

SUMMARY OF THE INVENTION

The present invention provides methods and apparatus for processing substrates having an image printed thereon using a phase change ink to produce a processed ink layer having one or more generally flat surfaces arranged on one or more planes. The methods of the present invention preferably include application of a combination of heat and pressure to a printed substrate using platens, rollers, plates, or a combination thereof to provide pressure application assemblies. The processing apparatus, or a portion of the processing apparatus that contacts the printed substrate, is preferably heatable to a temperature at which the solidified, printed ink droplets soften and become malleable, permitting reorientation of the ink droplets without liquefying the ink. Apparatus having large contact surface areas are preferred to reduce the time required for processing. Application of light transmissive coatings such as wax to the printed ink layer to produce a composite image is also disclosed.

According to preferred embodiments of the methods and apparatus of the present invention, a resilient contact surface is positioned adjacent the printed substrate during application of pressure. Application of pressure promotes reorientation of ink droplets having curved surfaces to provide a printed ink layer having one or more levels of generally flat surface conformations. The methods and apparatus of the present invention also preferably employ a release sheet positioned between the printed surface of a substrate and the adjacent surface of the processing apparatus. The release sheet prevents the printed ink from adhering to surfaces of the processing apparatus during processing, thereby preserving both the quality of the printed image and the cleanliness of the apparatus. A preferred release sheet comprises a thin polymeric sheet coated with silicone.

Preferred embodiments may also involve mechanical polishing or buffing of a printed image after a processing step to provide a smooth, glossy surface on the image. Mechanical polishing of the printed ink layer is especially effective when printed substrates have been processed, initially, using a textured roller. Mechanical buffing smooths the top, textured layer of the image, to provide an ink layer having one or more generally flat surface areas that yields saturated, uniform colors when the image is projected.

According to yet another preferred embodiment, the printed image may be treated to provide a thin protective layer covering the printed ink layer. The protective layer comprises wax, for example, and preferably has a lower temperature melting point than that of the ink to prevent smearing of the image during a polishing process. The protective layer may be applied as a fine powder or a liquid dispersion during the mechanical buffing process, or by means of a wax transfer process.

The processing methods and apparatus of the present invention are preferably incorporated in a post-printing processing step utilized in conjunction with a high speed ink jet printing device, such as a drop-on-demand ink jet printer. Processing methods of the present invention are especially suitable for use with light transmissive inks and substrates. Processed, printed substrates exhibit a high degree of lightness and chroma and transmit light in a substantially rectilinear path. Printed, light transmissive substrates processed according to the methods of the present invention may be used in a projection device to project an image containing clear, saturated colors. Printed substrates of the present invention additionally exhibit reduced banding effects, reduced offset problems, and improved durability.

The foregoing and other objects, features and advantages of the present invention will be more readily apparent from the following detailed description of preferred embodiments which proceeds with reference to the drawings.

BRIEF DESCRIPTION OF THE DRAWINGS

FIG. 1(*b*) is a schematic representation illustrating the substantially rectilinear transmission of light beams from a light projection source through a printed substrate having a printed ink layer of generally uniform thickness.

FIG. 2(*b*) is a schematic representation illustrating the substantially rectilinear transmission of light beams through a multi-color printed substrate having,, generally flat surface conformations corresponding to areas of primary and secondary color.

DISCLOSURE OF THE INVENTION

Phase change inks useful in accordance with the present invention are solid at ambient temperatures and liquid at printing temperatures. Phase change inks preferably exhibit the following characteristics: low viscosity in the liquid phase; transparency and durability in the solid phase; and malleability at intermediate temperatures to facilitate manipulation. Light-transmissive phase change inks are preferred. Phase change inks disclosed, for example, in U.S. Pat. No. 4,889,761, which is incorporated herein by reference in its entirety, are suitable.

Suitable printing substrates may be permeable, such as paper and the like, or substantially impermeable, such as light reflective films, light transmissive films (e.g., polymeric films including polyester films) and the like. Phase change ink becomes at least partially embedded within the structure of a permeable substrate during processing according to the present invention. For example, if the substrate is paper, the ink fills the voids between the paper fibers. Processing according to the present invention improves the durability of the printed image and increases the bonding contact area and ink penetration into the bulk structure of the paper. Moreover, processing enhances the overall efficiency of the printing operation because it increases the surface area coverage of the printed ink and smaller ink drops may be applied.

Ink droplets printed on substantially impermeable substrates become reoriented during processing according to the present invention, such that the processed ink layers have generally flat surface conformations corresponding to areas having different masses of ink. Reorientation of the printed ink layer is particularly important for applications involving light transmissive substrates, such as transparent films. Reorientation of the printed ink layer in accordance with the present invention is illustrated in FIGS. 2(*a*) and 2(*b*).

Figure 2A:
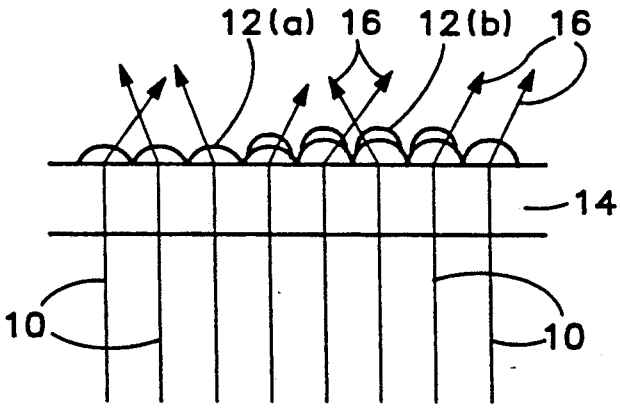
FIG. 2(*a*) is a schematic representation illustrating the substantially non-rectilinear transmission of light beams through a multi-color substrate having a multi-colored printed ink layer with a non-uniform surface conformation.
Figure 2B:
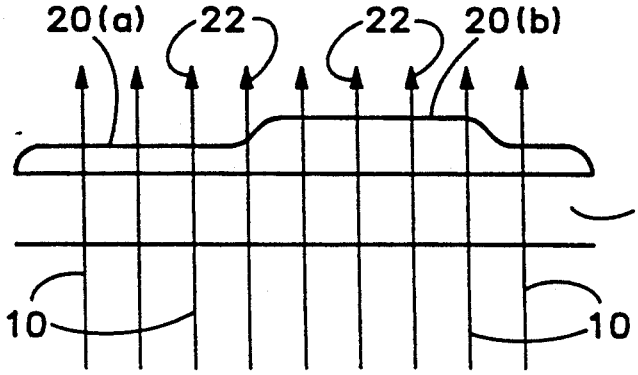

FIG. 2(*a*) schematically illustrates the surface conformation of a printed image comprising ink layers having different masses of ink applied. Subtractive color printing techniques employing phase change inks require application of multiple ink droplets for non-primary colors. Black and primary colors require a single ink droplet. Thus, as shown in FIG. 2(*a*), ink droplet 12(*a*) corresponds to a black or primary color requiring a single ink droplet, while ink droplet 12(*b*) corresponds to a secondary color that requires the application of two ink droplets. Impinging light beams 10 are refracted as they are transmitted through ink droplets 12(*a*) and 12(*b*) and refracted light beams 16 are directed away from the collection lens of a projection system. The projected image has a dull, grayish cast.

Figure 1A:
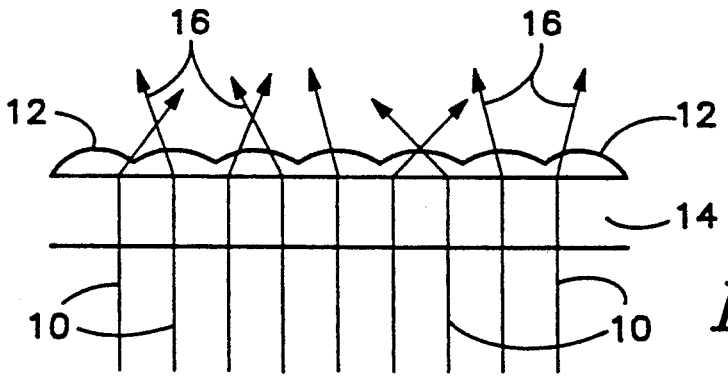
FIG. 1(*a*) is a schematic representation illustrating the substantially non-rectilinear transmission of light beams from a light projection source through a printed substrate having a printed ink layer of thickness.
Figure 1B:
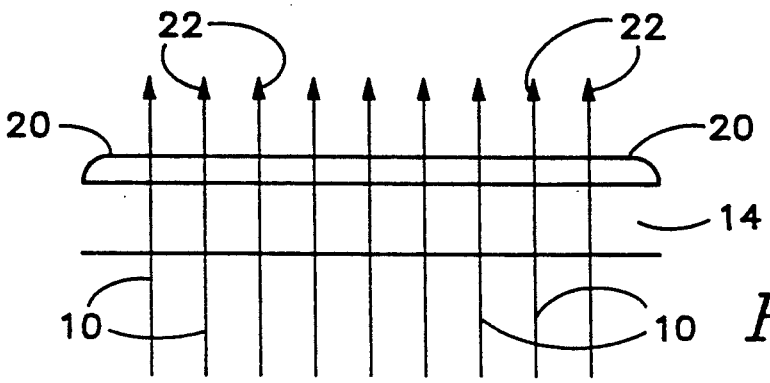

Experimental results suggest that it may not be necessary to reorient the printed ink layer to provide a layer of uniform thickness over its entire surface area, as illustrated in FIG. 1(*b*). Rather, reorientation of the printed ink droplets to provide processed ink layers having one or more generally flat surface conformations arranged on different planes facilitates rectilinear transmission of impinging light beams through printed light transmissive substrates. FIG. 2(*b*) schematically illustrates the surface conformation of a printed ink layer that has been re-oriented to provide a processed ink layer having one or more substantially flat surface conformations corresponding to areas having different masses of ink. Ink layers 20(*a*) and 20(*b*) correspond to ink droplets 12(*a*) and 12(*b*), respectively, and transmit impinging light beams 10 as rectilinear light beams 22.

The term "processing," as used herein, refers to the manipulation of a printed ink layer to provide an ink layer having one or more substantially flat surface conformations arranged on one or more planes corresponding to areas where different masses of ink have been applied. Processing according to the present invention may involve reorientation of a printed ink layer by application of pressure during a temperature-controlled operation. Processing may alternatively or additionally involve application of a clear, protective coating and/or a mechanical buffing treatment.

Processing methods of the present invention include elevating the temperature of the printed ink layer to a temperature at which the ink is malleable and simultaneously applying pressure to the printed substrate. The printed substrate is preferably supported by a resilient support means during processing. Resilient support means useful in the practice of the present invention are capable of withstanding the application of elevated temperatures and pressures required for processing. Silicone rubber pads having a Durometer of about 50 (Shore A) and a thickness of about 0.2 inches were purchased from McMaster-Carr Supply Company, Catalog No. 8632K15, and performed well in experimental test procedures.

In processing apparatus comprising one or more platens, the resilient support means is preferably provided as a layer positioned adjacent the printed substrate contact area of the platen. Alternatively, in processing apparatus utilizing rollers, the resilient support means is preferably provided as an outer layer on the roller. A resilient support means having a Durometer of about 50 Shore A preferably has thickness of about 0.05 to about 0.3 inches, and most preferably about 0.2 inches.

Processing according to the present invention is preferably accomplished at a temperature at which the phase change ink printed on the substrate is soft and malleable, but not liquid. Phase change ink compositions typically used for drop-on-demand printing applications have relatively sharp phase change characteristics, whereby the phase change takes place within a narrow temperature range of about 5°-10°. The desired ink temperature for processing according to methods of the present invention is at or about the softening point. For the phase change ink compositions preferred for use in accordance with the present invention and disclosed in U.S. Pat. No. 4,889,761, temperatures of from about 58° C. to about 65° C. are suitable. Temperatures of from about 60° C. to 65° C. are preferred, and temperatures of 62° C. to 65° C. are especially preferred. A practitioner in the art would be able to determine appropriate processing temperatures at which different ink compositions would be malleable without being liquid.

Reorientation of the ink droplets is accomplished by application of pressure sufficient to reconfigure the malleable ink droplets having various surface conformations to provide an ink layer having one or more substantially flat surface conformations corresponding to areas having different masses of ink. Suitable contact pressures vary depending upon the configuration of the apparatus, but contact pressures of from about 400 to about 4000 psi are generally suitable. Contact pressures of from about 500 to about 800 psi are generally preferred when large contact surfaces are employed. Contact pressures of from about 2500–4000 psi are generally preferred when roller apparatus having smaller contact surface areas are employed.

The methods and apparatus of the present invention also preferably involve use of a release sheet during processing. The release sheet includes an ink release layer that is positioned adjacent the printed ink image during processing. The release sheet prevents the ink from adhering to surfaces of the processing apparatus, thereby preserving the quality of the printed image and protecting the processing apparatus from ink deposition. The release layer also facilitates smoothing of the printed surface. Exemplary release layers include thin sheets or films coated with a material to which phase change inks do not adhere. Such release sheets may be constructed from any convenient material, such as polymeric sheet materials, including MYLAR ® or the like, coated with an ink release material such as silicone. Release layers used in the practice of the present invention are sized and configured to be at least co-extensive with the printed surface area of substrates.

Figure 3:
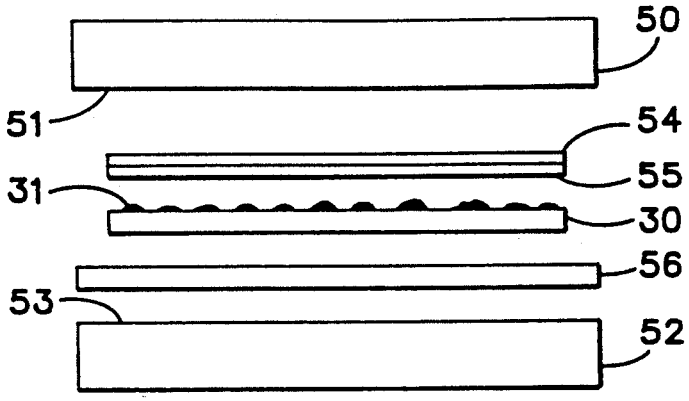
FIG. 3 is an exploded side view schematic representation of a dual platen processing apparatus according to the present invention with a printed substrate positioned therein for processing.
Figure 4:
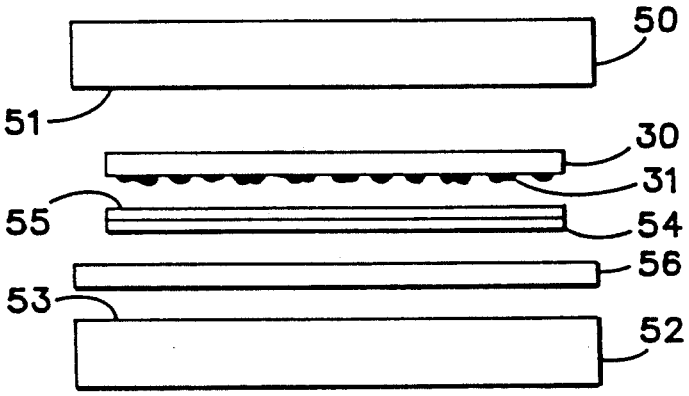
FIG. 4 is an exploded side view schematic representation of a dual platen processing apparatus according to the present invention with a printed substrate positioned therein for processing.

Exemplary processing apparatus are shown schematically in FIGS. 3–8. A dual platen processing apparatus having a printed substrate positioned therein for processing is illustrated in FIGS. 3 and 4. The processing apparatus comprises a first platen 50 and a second platen 52 mounted for movement relative to one another between a substrate insertion position, wherein the first and second platens are in a spaced apart relationship and a pressure application position, wherein the platens apply a substantially uniform pressure over the surface area of a printed substrate 30. A dual platen processing apparatus of this type may be utilized in a variety of orientations, provided that the first and second platens are positioned so that their contact surfaces 51 and 53, respectively, are substantially parallel to one another in the pressure application position.

As illustrated in FIGS. 3 and 4, an ink layer 31 printed on substrate 30 may face the contact surface of either platen. A release surface 55 of a release sheet 54 is disposed adjacent ink layer 31 of printed substrate 30. A resilient support means 56 is positioned between one of the platens and printed substrate 30. Resilient support means 56 and release sheet 54 preferably have dimensions at least co-extensive with those of substrate 30. Resilient support means 56 may be permanently mounted on the contact surface of one of the platens, or it may be provided as a removable layer. The processing configuration illustrated in FIG. 4, wherein ink layer 31 faces resilient support means 56 is preferred for many applications.

One or both of platens 50 and 52 are preferably heated to preferred processing temperatures of about 58° C. to about 65° C. during substrate processing. Pressure may be applied to platens 50 and/or 52 in any convenient manner. For example, platens 50 and 52 may be incorporated in a conventional platen press design, wherein a manual or automatic actuator applies force to at least one of the platens to exert pressure on printed substrate 30. Substantially uniform pressure is applied simultaneously to the entire surface area of the printed substrate by means of the dual platen apparatus. Processing times using a dual platen apparatus are reasonably short as a result of the large contact area.

A processing apparatus was constructed in accordance with the arrangement shown in FIG. 4, using a dual platen press apparatus (PHI Model No. P-2150, City of Industry, Calif.), a silicone coated release sheet, and a resilient support means comprising a layer of silicone rubber purchased from McMaster-Carr Supply Company, Catalog No. 8632K15, having a Durometer of about 50 Shore A and a thickness of about 0.188". The printed substrate comprised a layer of ink having a composition substantially similar to ink compositions disclosed in U.S. Pat. No. 4,889,761 printed on a light transmissive polymeric sheet by means of a drop-on-demand ink jet printer. Both the upper and lower platens were heated to a temperature of about 65° C. during processing. Application of about 500–800 psi pressure for a processing time of about 11 seconds yielded a processed, printed substrate having an ink layer characterized by a substantially uniform thickness and a substantially flat surface conformation corresponding to each discrete color. The printed image, when projected by means of an overhead projection device, produced a projected image characterized by clarity, sharpness and full color.

Figure 5:
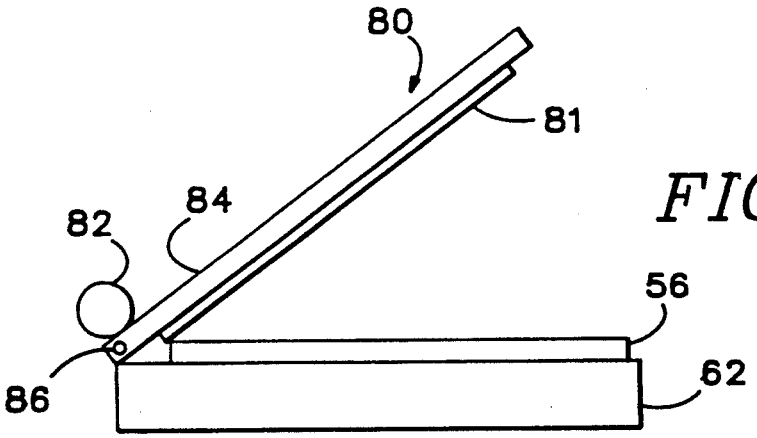
FIG. 5 is a side view schematic representation of another arrangement employing a platen and a roller for processing printed substrates.

FIG. 5 illustrates another processing apparatus according to the present invention comprising a pressure application assembly 80 and a stationary platen 62. Resilient support means 56 has the characteristics described above and is mounted on a substrate contact face 61 of platen 62. Pressure application assembly 80 includes a generally cylindrical roller 82, and a substantially rigid, planar plate 84 mounted for rotation about pivot axis 86. Pivoting of plate 84 about pivot axis 86 facilitates application of pressure to a printed substrate positioned adjacent resilient support means 56. Pivot axis 86 is preferably aligned on the desired contact plane between the printed substrate and resilient support means 56.

Roller 82 is preferably constructed from a rigid material such as stainless steel, or the like. Rollers having a diameter of about 2" are preferred. Plate 84 is preferably constructed from a rigid material and has surface area dimensions corresponding generally to those of platen 62. Both plate 84 and platen 62 preferably have dimensions that are slightly larger than those of printed substrates to be processed.

Plate 84, or platen 62, or both, may be heated during processing to a temperature that renders the printed ink in a malleable form. Plate 80 may have a release sheet or, alternatively, a release surface 81 provided on its contact surface. Alternatively, a release sheet or a release surface may be provided on the contact surface of resilient support means 56.

A printed substrate is positioned between platen 62 and pressure application assembly 80 for processing. During processing, roller 82 traverses the upper surface of plate 84. Roller 82 thereby exerts pressure, through plate 84, on a printed substrate positioned between pressure application assembly 80 and stationary platen 62. Roller 82 travels along a path substantially parallel to the contact surface of resilient support means 56 and preferably exerts a pressure of about 400 to about 1200 psi on the printed substrate. After processing, roller 82 is returned to a release position and plate 84 may be pivoted about pivot axis 86 to release the processed, printed substrate. This apparatus offers the advantage of lower force requirements.

Figure 6:
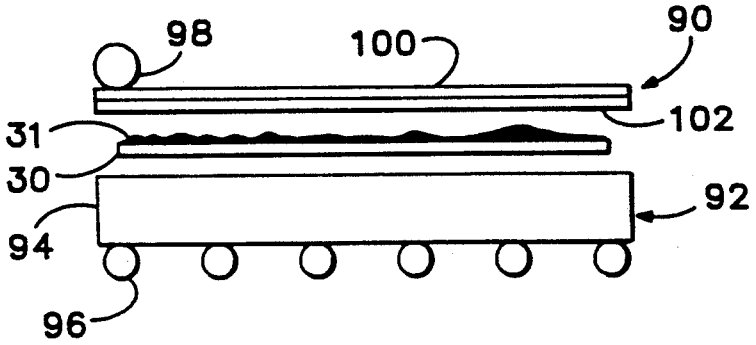
FIG. 6 is an exploded side view schematic representation of another embodiment of a processing apparatus according to the present invention.

FIG. 6 illustrates yet another processing apparatus according to the present invention. This processing apparatus includes a pressure application assembly 90 and a movable platen 92. Movable platen 92 includes a rigid, generally planar plate 94 constructed from a rigid, durable material, such as steel, mounted on a plurality of wheels 96. The surface area of plate 94 is at least coextensive with that of printed substrates desired to be processed. Wheels 96 are sized and configured to support plate 94 during the application of pressure and to permit plate 94 to move in a substantially rectilinear path.

Pressure application assembly 90 includes a generally cylindrical roller 98, a substantially planar member 100 and a resilient support means 102. Roller 98 is preferably constructed from a rigid material such as stainless steel, or the like. Rollers having a diameter of about 2" are preferred. Planar member 100 is preferably constructed from a fairly thin sheet of a substantially rigid material, such as spring steel having a high yield point that retains its planar conformation in an unloaded condition, notwithstanding repeated processing cycles. During processing, however, planar member 100 flexes slightly to convey pressure to the printed substrate. Planar member 100 is sized and configured to have a contact surface area at least co-extensive with that of movable platen 92 and printed substrates to be processed. A release sheet or a release surface may be provided in conjunction with platen 92 or pressure application assembly 90.

Operation of the processing apparatus shown in FIG. 6 involves placement of a printed substrate between platen 92 and a pressure application assembly 90 and reciprocation of movable platen 92 in concert with the travel of roller 98 along planar member 100. The processing apparatus is illustrated in a rest, or start, position in FIG. 6. In that position, roller 98 is positioned at one side of planar member 100 and movable platen 92. During processing, platen 92 and roller 98 are moved at substantially the same velocity along generally parallel paths to apply pressure to the printed substrate.

After roller 98 has traversed planar member 100, the processed printed substrate may be removed and the apparatus returned to its initial, starting position. Alternatively, platen 92 and roller 98 may be moved along generally parallel paths in the opposite direction to provide additional processing and to return the apparatus to its initial, starting position. The processed, printed substrate may then be removed and the apparatus is ready for another processing cycle. Contact pressures of about 400 to 1200 psi at temperatures that render the printed ink layer malleable are preferred.

Figure 7:
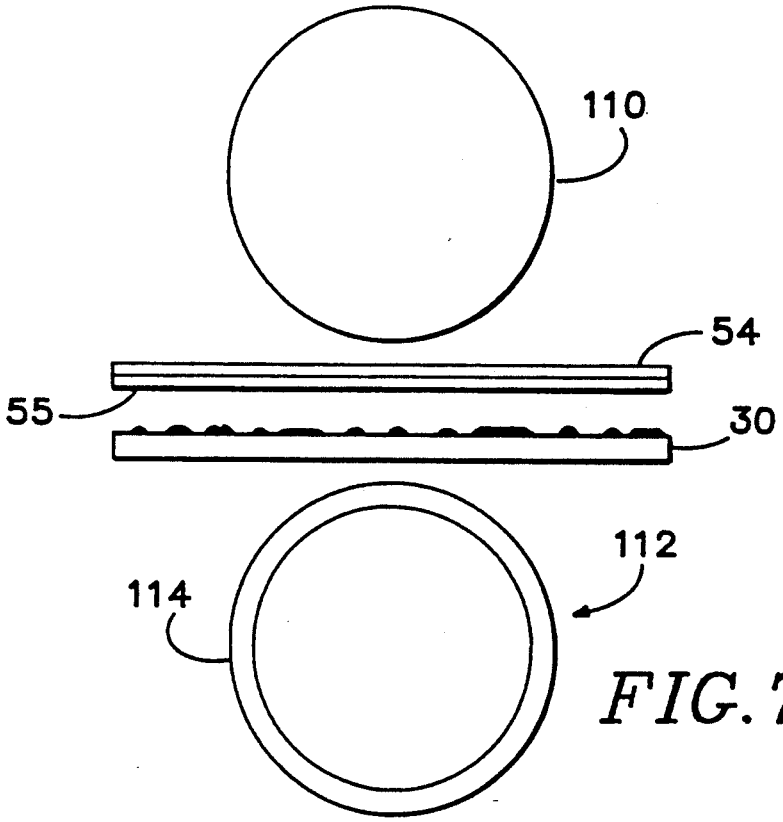
FIG. 7 is an exploded side view schematic representation of a dual roller processing apparatus according to the present invention.

FIG. 7 illustrates a dual roller processing apparatus useful in the practice of the present invention. The dual roller apparatus includes first roller 110 constructed from a rigid material and second composite roller 112, having a resilient support means 114 in the form of an outer resilient layer. Rigid roller 110 and composite roller 112 preferably have substantially the same outer diameter. Diameters of about 1" to 3" are preferred, and rollers having a diameter of about 2" are especially preferred. Release sheet 54 having release surface 55 is preferably positioned adjacent printed ink layer 31 on substrate 30. Alternatively, roller 110 may be provided with a release surface.

Rollers 110 and 112 are positioned to apply pressure to a printed substrate at a roller interface upon rotation of the rollers in opposite directions. Short contact lengths, e.g., of about 0.25" are preferred, and orienting the rollers in a skewed orientation may be helpful. Processing pressures of about 600 to about 4000 psi are generally suitable, and processing pressures of about 2500–4000 psi are generally preferred. At the higher pressure ranges, processing of the printed substrate may be accomplished in several seconds.

Mechanical buffing or polishing of the printed image subsequent to reorientation provides a glossy, smooth surface that transmits light in a generally rectilinear path. Mechanical buffing or polishing provides a printed ink layer having substantially flat surface conformations, at least with respect to printed areas having similar masses of ink applied. Buffing may be achieved by a high-speed buffing brush or similar device.

Figure 8:
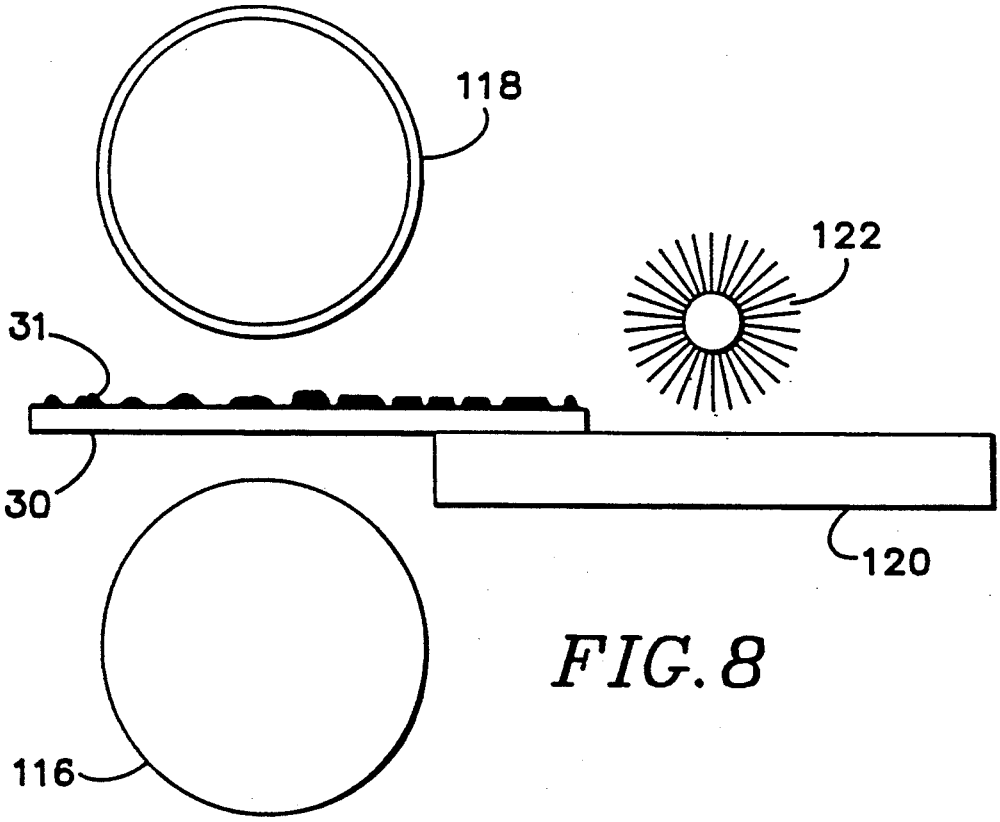
FIG. 8 is an exploded side view schematic representation of a dual roller processing apparatus and a mechanical buffing means according to the present invention.

FIG. 8 illustrates a processing apparatus incorporating a buffing device. Printed substrate 30 is first processed to reorient the printed ink layer by passing between rollers 116 and 118. According to a preferred embodiment, roller 116 is constructed from a substantially rigid, metallic material and smooth roller 114 is constructed from a rigid, synthetic material.

Heat is preferably applied to printed substrate 30 prior to and/or during the reorientation processing step. Printed substrate 30 then passes over a support surface 120 and is contacted by burnishing roller 122. The ink layer is preferably in a solid condition during the buffing operation. The buffing device is preferably designed and positioned to contact and abrade the upper surface of the printed ink layer to provide a generally smooth, flat surface conformation corresponding to areas of the printed image having similar masses of ink applied.

As an alternative to, or in addition to the buffing process, printed substrates that have been reoriented may be processed by overcoating with a protective, light transmissive layer, such as wax. Suitable materials have an index of refraction substantially similar to that of the printed ink layer to provide substantially rectilinear transmission of light through the composite ink/-protective coating layer. The material comprising the protective layer preferably has a melting point lower than that of the ink printed on the substrate surface. Buffing of the protective coating may be provided after its application to the printed ink surface. Application and/or buffing of a protective layer is especially useful after a printed substrate has been subjected to the application of pressure using one of the pressure application techniques described herein.

Application of a thin protective coating of an optically transparent, phase change material such as wax may be accomplished using thermal transfer processes. Wax transfer ribbons such as those employed with a Textronix Model 4693 DX color printer are commercially available and would be suitable for use in such thermal wax transfer processes, provided that clear wax is substituted for the colored wax typically utilized. Thermal wax transfer techniques employed with different types of printers would also be suitable. Application of a protective coating using thermal wax transfer techniques may also serve to reorient the printed ink layer and may be advantageous with or without a prior ink reorientation process. Alternatively, a protective coating may be applied prior to or during buffing as a fine powder or a liquid dispersion.

While in the foregoing specification, this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

We claim:

1. A method for processing a substrate printed with a phase change ink layer comprising:

providing a first planar surface and a second planar surface, each having a contact surface area at least generally coextensive with the surface area of the phase change ink layer, said first and second planar surfaces adjustable between a substrate insertion position wherein said first and second planar surfaces are spaced apart and a pressure application position wherein said first and second planar surfaces are aligned on substantially parallel planes;

inserting the substrate printed with the phase change ink layer between said first and second planar surfaces in said substrate insertion position; and adjusting said first and second planar surfaces to said pressure application position and applying a contact pressure to the entire surface area of the phase change ink layer simultaneously.

2. A method according to claim 1, additionally comprising:

heating at least one of said first and second planar surfaces to a temperature intermediate a solid phase and a liquid phase temperature of the phase change ink layer.

3. A method according to claim 1, additionally comprising:

positioning a resilient support means having a thickness greater than that of the substrate and the phase change ink layer between said first and second planar surfaces.

4. A method according to claim 1, additionally comprising:

positioning an ink release surface that is non-adherent to the phase change ink layer adjacent the phase change ink layer during processing and thereby inhibiting transfer of ink from the phase change ink layer during application of the contact pressure.

5. A method according to claim 3, wherein said resilient support means comprises silicone rubber.

6. A method according to claim 3, wherein said resilient support means has a Durometer of about 50 Shore A.

7. A method according to claim 1, comprising applying a contact pressure of about 400 to about 4000 psi between said first and second planar surfaces.

8. A method according to claim 7, comprising applying a contact pressure of about 500 psi to about 800 psi between said first and second planar surfaces.

9. A method according to claim 1, wherein the substrate is light transmissive.

10. A method for processing a substrate printed with a phase change ink layer comprising:

applying a contact pressure to the entire surface area of the phase change ink layer simultaneously by means of one or more generally planar contact surfaces having a surface area at least generally coextensive with that of the phase change ink layer.

11. A method according to claim 10, wherein the contact pressure is applied to substantially the entire surface area of the phase change ink layer simultaneously by pressing the substrate between two contact surfaces, each of the contact surfaces having a surface area at least generally coextensive with that of the phase change ink layer.

12. A method according to claim 10, wherein the substrate is light transmissive.

13. A method according to claim 10, additionally comprising reorienting the surface conformation of areas printed with different volumes of phase change ink per unit surface area by applying a contact pressure to the surface of the phase change ink layer.

14. A method for processing a substrate printed with a phase change ink layer having a non-uniform surface conformation comprising:

polishing an exposed surface of the phase change ink layer and thereby providing one or more generally planar ink surfaces.

15. A method according to claim 14, wherein the polishing is achieved by means of a mechanical buffing apparatus.

16. A method according to claim 14, additionally comprising:

reorienting the surface conformation of the ink layer prior to polishing said exposed surface of the ink layer by applying a contact pressure to the surface of the phase change ink layer.

17. A method according to claim 16, wherein said contact pressure is applied to the surface of the phase change ink layer using a roller.

* * * * *